US005081783A

United States Patent [19]

Jarvis

[11] Patent Number: 5,081,783

[45] Date of Patent: Jan. 21, 1992

[54] DEVICE FOR SUPPORTING AND SIGHTING A FIREARM

[76] Inventor: Robert N. Jarvis, P.O. Box 1503, Cortez, Colo. 81321

[21] Appl. No.: 709,614

[22] Filed: Jun. 3, 1991

[51] Int. Cl.[5] ..... F41A 23/00

[52] U.S. Cl. ..... 42/94

[58] Field of Search ..... 42/94; 89/37.04

[56] References Cited

U.S. PATENT DOCUMENTS 3,358,504 12/1967 Freebairn ..... 89/37.04

3,827,172 8/1974 Howe ..... 42/94

4,026,057 5/1977 Cady ..... 42/94

*Primary Examiner*—Charles T. Jordan

[57] ABSTRACT

A device for supporting and sighting firearms which can be used for reliably conveniently supporting and sighting or aligning the sights of both shoulder held firearms such as rifles and shotguns and hand-held firearms such as pistols; which is adapted to absorb the recoil of the firearm when the firearm is fired; and which is compact and relatively light-weight and; therefore, portable and easily manually movable.

10 Claims, 4 Drawing Sheets

DEVICE FOR SUPPORTING AND SIGHTING A FIREARM

BACKGROUND OF THE INVENTION

The present invention relates generally to a device for supporting and sighting shoulder-held firearms such as rifles or shotguns as well as hand-held firearms such as pistols.

Devices for sighting or aligning the sights of firearms are known in the art and generally comprise at least a base frame, butt and barrel supports mounted on opposing ends of the base frame to support the firearm, and include means for raising or lowering either or both of the butt and barrel supports to permit alignment of the sights of the firearm. Some of such devices are provided with complex recoil attenuating apparatus, and other such devices include elaborate clamping arrangements for holding the barrel or butt of the firearm or both in position on the respective barrel or butt supports.

Such prior art devices are for the most part, heavy, bulky and, therefore, difficult to transport manually. Further, such devices generally are designed to accommodate only shoulder-held firearms such rifles or shotguns or only hand-held firearms such as pistols, but are not adapted to be used for both.

SUMMARY OF THE INVENTION

The present invention overcomes the problems associated with the prior art devices and provides a device for supporting and sighting firearms which can be used for reliably and conveniently supporting and sighting or aligning the sights of both shoulder held firearms such as rifles and shotguns and hand-held firearms such as pistols; which is adapted to absorb the recoil of the firearm when the firearm is fired; and which is compact and relatively light-weight and, therefore, portable and easily manually moveable.

To achieve these objects in accordance with the invention, a device is provided for supporting and sighting a firearm which comprises a base member having forward and rearward ends, a butt support member engaged at the rearward end of the base member having means mounted thereon for receiving the butt of a firearm, barrel support means mounted on the base member, means disposed above the base member for receiving the barrel of a firearm, and a link, having means for adjusting the height of the barrel receiving means relative to the base member, pivoted at one end to the barrel support means and at its other end to the barrel receiving means to permit pivotal movement of the barrel receiving means relative to the base member between positions forward of the barrel support means to accommodate an elongate firearm such as a rifle or shotgun and rearward of the barrel support means to accommodate a firearm having a relatively short barrel such as a pistol.

Preferably, the barrel support means is moveable between selected positions lengthwise of the base member and includes means for locking the barrel support means in position on the base member to permit adjustment of the position of the barrel receiving means relative to the butt receiving means to accommodate minor differences in the lengths of the barrels of different firearms.

Additionally, in order to accommodate the respective configurations of the butt of a shoulder-held firearm, such as a rifle or shotgun, as well as the butt of a hand-held firearm, such as a pistol, preferably, the butt support member is rotatable relative to the longitudinal axis of the base member, and two butt receivers, one configured and dimensioned to receive the butt of a shoulder-held firearm and the other dimensioned and configured to receive the butt of a hand-held firearm, are mounted on the butt support member for pivotal movement about the longitudinal axis of the base member, upon rotation of the butt support member, between upright positions above the longitudinal axis of the base member and lateral positions relative to the longitudinal axis of the base member. The butt receivers are positioned, respectively, on the butt support member so that when one is pivoted to an upright position above the longitudinal axis of the base member, the other is caused to be pivoted to a lateral position relative to the longitudinal axis of the base member.

Further, in order to provide for attenuation of recoil when the firearm is fired, preferably the butt support means is engaged for slidable movement lengthwise relative to the base member at the rearward end of the base member, and a spring is fixed between the base member and the butt support member to absorb the force of recoil which is transmitted through the butt receiver and the butt support member to the spring fixed to the base member.

These and other objects and advantages of the present invention will become more apparent after consideration of the following detailed specification taken in conjunction with the accompanying drawings wherein like characters of reference designate like parts through the several views.

DETAILED DESCRIPTION OF THE DRAWINGS

Reference Will now be made in detail to a preferred embodiment of the invention which is illustrated in the accompanying drawings.

Figure 1:
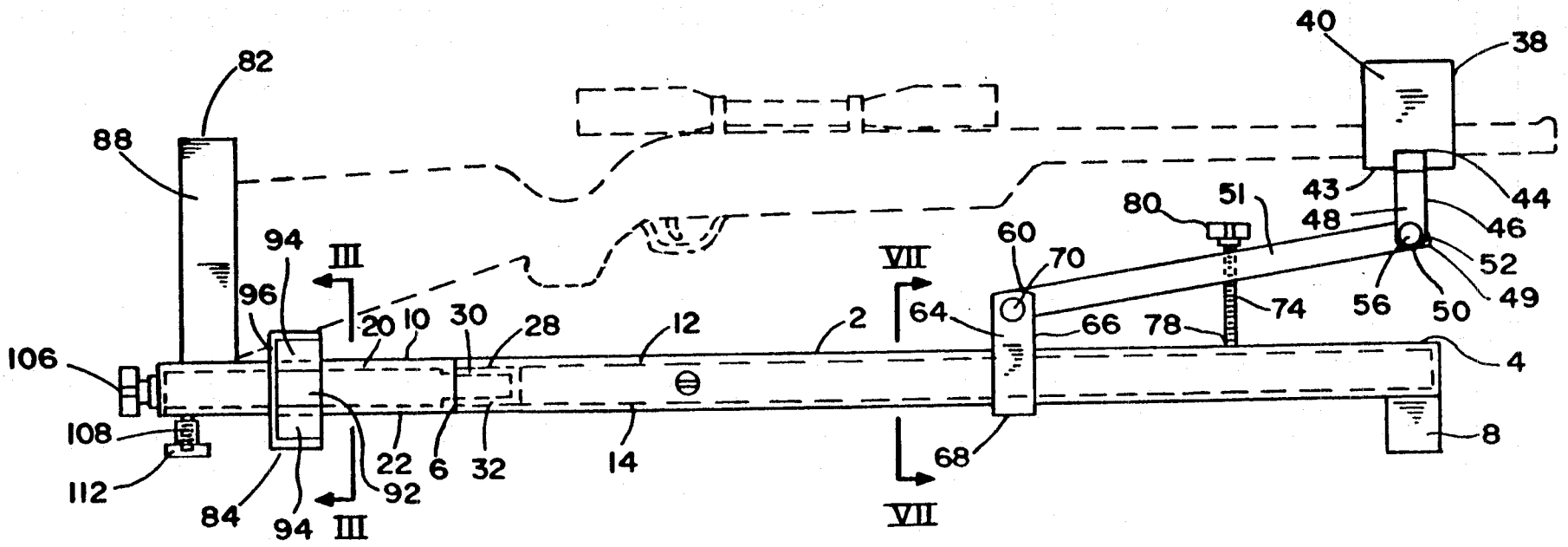
FIG. 1 is a side elevational view of a device for supporting and sighting a firearm embodying the invention showing the positions of the parts when a rifle is supported thereon.
Figure 2:
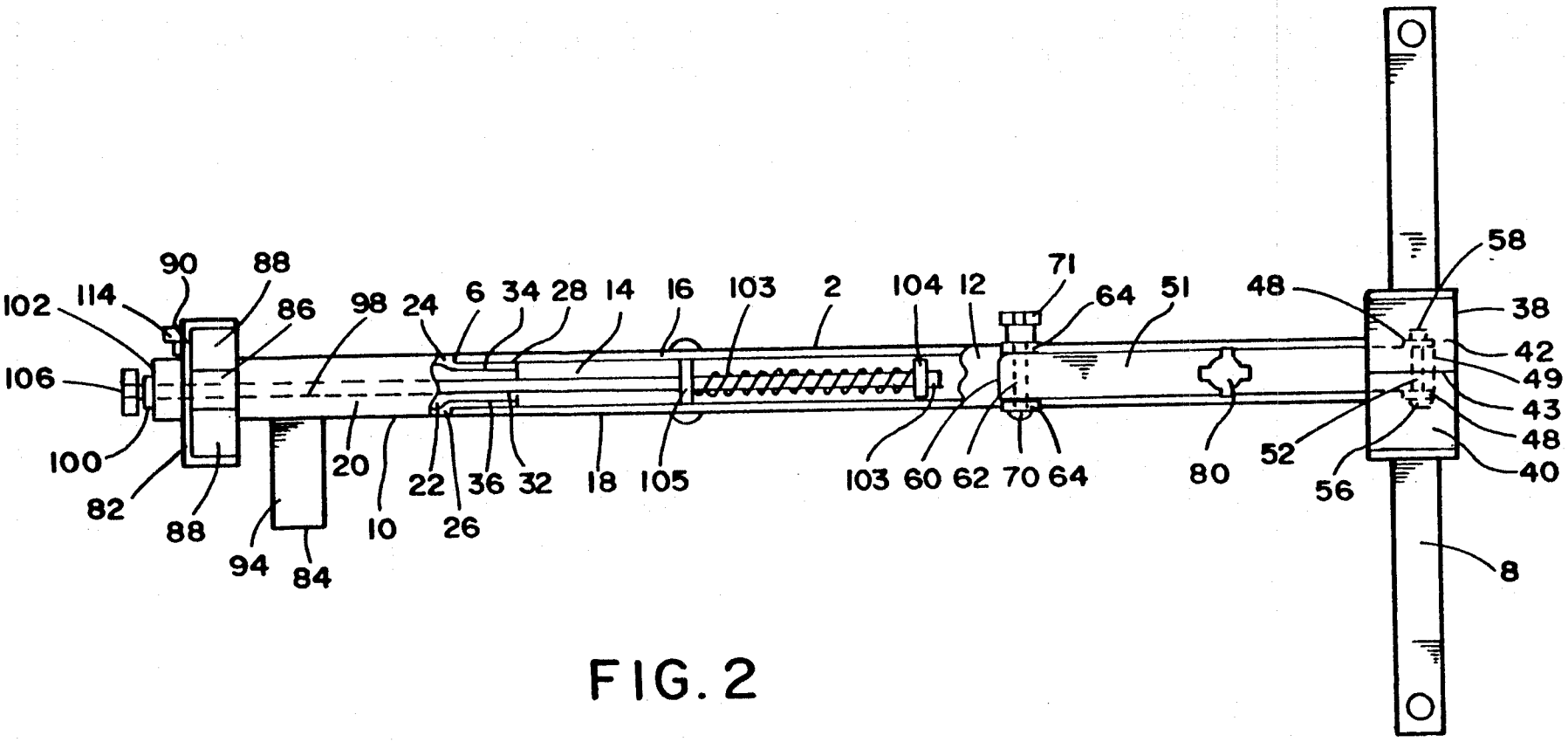
FIG. 2 is a top plan view of the device of FIG. 1 with a portion of the top of the base member and butt support member removed.

Referring to FIG. 1, the device for supporting and sighting a firearm comprises a base member 2, having a forward end 4 and an opposing rearward end 6, a stabilizing cross member 8, FIG. 2, fixed at forward end 4 of base member 2, and a butt support member 10 engaged at rearward end 6 of base member 2. Base member 2 has a rectangular cross-section and a hollow, rectangular interior defined by a top 12, bottom 14, and opposing sidewalls 16, 18, FIG. 2. Butt support member 10 also has a rectangular cross-section and a hollow, rectangular interior defined by top 20, bottom 22, and opposing sidewalls 24, 26, FIGS. 1, 2, and is provided with an extension 28, FIGS. 1, 2, likewise having a rectangular cross-section and a hollow, rectangular interior defined by top 30, bottom 32, and opposing sidewalls 34, 36, FIGS. 1, 2. Top 30, bottom 32, and sidewalls 34, 36 of rectangularly shaped extension 28 are dimensioned to be snugly received by the correspondingly rectangularly shaped hollow interior of base member 2 at its rearward end 6.

Figure 6:
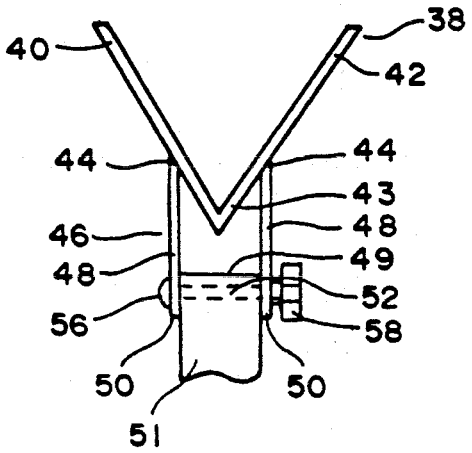
FIG. 6 is a fragmentary front view of the barrel receiver of the device of FIG. 1.

Barrel receiver 38, FIGS. 6, disposed above base member 2, includes a pair of obliquely disposed upstanding opposing sidewalls 40, 42, FIGS. 2, 6, connected to each other at their respective bottom edges 43. Sidewalls 40, 42 of barrel receiver 38, are fixed, respectively, to the upper ends 44 of strut 46 which comprises a pair of opposing spaced apart upstanding strut members 48, FIGS. 1, 6. Strut 46 is pivoted at the respective bottom ends 50 of strut members 48 on screw 52 which is rotatably mounted through holes formed in each of strut members 48 proximate the respective bottom ends 50 of strut members 48 and through a corresponding hole formed proximate end 49 of link 51. Screw 52 has a head 56 formed at one of its opposing ends disposed adjacent one of strut members 48 and the other end of screw 52 is threaded to be rotatably received by a correspondingly threaded nut 58 adjacent the other of strut members 48 which can be loosened to permit pivotal movement of strut 46 relative to link 51 and tightened to urge strut members 48 together against end 49 of link 51 to lock strut 46 in position against further pivotal movement relative to link 51. Preferably, threaded nut 58 includes a knob fixed thereon for ease of manually rotating threaded nut 58. Barrel receiver 38 may have a padded cover (not shown) to prevent scratching or marring of the barrel of the firearm from sharp edges or hard surfaces of barrel receiver 38 and to afford a snug fit of the barrel therein.

Figure 7:
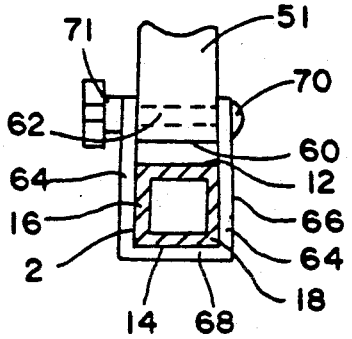
FIG. 7 is a fragmentary rear view of the barrel support member of the device of FIG. 1 along with line VII—VII of FIG. 1.

Referring now to FIG. 7, link 51 is pivoted at its opposing end 60, FIGS. 1, 7 on carriage bolt 62 rotatably mounted through holes formed in the respective opposing upstanding legs 64 of U-shaped bracket 66 and through a corresponding hole formed in link 51 proximate its end 60. Bottom member 68 of bracket 66, connecting the respective legs 64 of U-shaped bracket 66 extends under base member 2. Carriage bolt 62 has a head 70 disposed adjacent one of legs 64 of bracket 66 and an opposing threaded end which is rotatably received by correspondingly threaded nut 71 disposed adjacent the other one of legs 64 of bracket 66. Nut 71 can be manually turned to tighten and loosen nut 71 on carriage bolt 62. Preferably, nut 71 includes a knob fixed thereon for ease of manually rotating nut 71. Thus, nut 71 on carriage bolt 62 can be loosened to permit pivotal movement of link 51 and connected barrel receiver 38 relative to base member 2 between positions forward of bracket 66 to accommodate an elongate firearm such as a rifle, FIG. and rearward of bracket 66 to accommodate a relatively short firearm such as a pistol, FIG. 4. Simultaneously, barrel receiver 38 can be pivoted at end 49 of link 51, with a loosening of threaded nut 48, to a position to receive either the barrel of an elongate firearm when link 51 is pivoted to a forward position, FIG. 1, or the barrel of a pistol, FIG. 4, when link 51 is pivoted to a rearward position.

In order to permit further adjustment of the distance between the barrel receiver and the butt receiver, to accommodate minor differences in the lengths of the barrels of different firearms, bracket 66 is dimensioned relative to base member 2 to permit slidable movement of bracket 66 lengthwise of base member 2 upon loosening of nut 71 on carriage bolt 62 and to permit locking of bracket 66 in position on base member 2 on tightening of nut 71 on carriage bolt 62 thereby urging opposing legs of bracket into gripping contact with opposing sidewalls 16, 18 of base member 2. Likewise, upon tightening of nut 71 on carriage bolt 62, opposing legs 64 of bracket 66 are urged into locking relationship with link 51 proximate its end 60.

Figure 4:
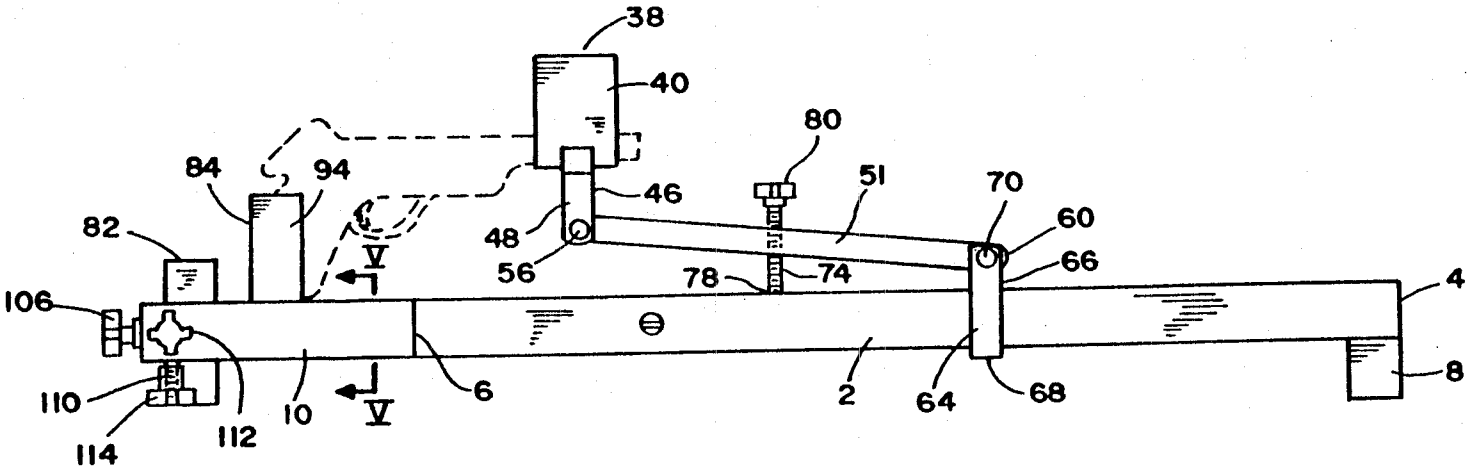
FIG. 4 is a side elevational view of the device of FIG. 1 showing the positions of the parts when a pistol is supported thereon.

For adjusting the height of barrel receiver 38 relative to base member 2, link 51 carries threaded adjusting screw 74 rotatably mounted in a correspondingly threaded hole formed in link 51 intermediate opposing ends 49, 60 of link 51. One end 78 of adjusting screw 74 rests on base member 2, and a knob 80 is fixed at the opposing end of adjusting screw 74 for manually rotating adjusting screw 74. When link 51 is pivoted relative to base member 2 from a forward to a rearward position relative to bracket 66, adjusting screw 74 can be completely removed from the threaded hole of link 51 and reinserted in said hole from the opposing side of link 51 as shown in FIG. 4.

Figure 3:
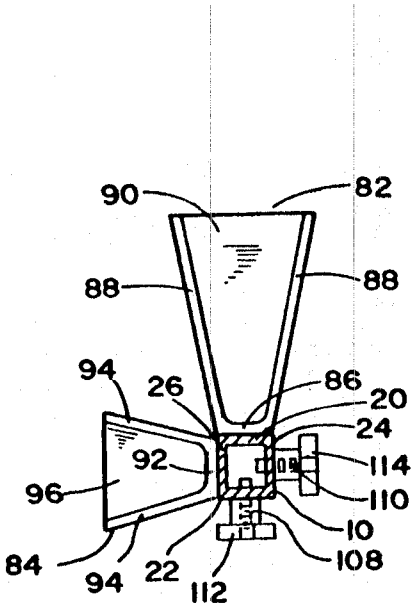
FIG. 3 is a transverse cross-sectional view of the device of FIG. 1 along the line III—III of FIG. 1.

Referring next to FIGS. 1, 3, butt receivers 82, 84 are fixed, respectively, to top 20 and sidewall 26 of butt support member 10. Butt receiver 82 has a bottom 86 and opposing obliquely disposed sidewalls 88 supporting a back wall 90 therebetween and is dimensioned and configured to receive the butt of a shoulder-held firearm such as a rifle or shotgun. Butt receiver 84 has a bottom 92 and opposing obliquely disposed sidewalls 94 supporting a back wall 96 therebetween and is dimensioned and configured to receive the butt of a hand-held firearm such as pistol. Butt receivers 82, 84 may have a padded cover (not shown) to avoid marring or scratching of the butt of the firearm received therein from sharp edges or hard surfaces of butt receivers 82, 84 and to afford a snug fit of the butt of a firearm therein.

Referring to FIG. 2, extension 28 of butt support member 10 is slidably engaged at rearward end 6 of base member 2 to permit rearward movement of butt support member 10 lengthwise relative to base member 2. Rod 98 extends exterior of end 102 of butt support member 10 and is provided with flange 100 disposed adjacent end 102 of butt support member 10. Rod 98 is rotatably received through a hole formed in end 102 of butt support member 10 and extends through the hollow interior of butt support member 10 and into the hollow interior of base member 2. The opposing end 103 of rod 98 is threaded and rotatably engaged by threaded nut 104 disposed within the rectangularly shaped hollow interior of base member 2, and compression spring 103, embracing rod 98, is fixed between threaded nut 104 and spring stop 105, which is disposed intermediate threaded nut 104 and rearward end 6 of base member 2 and fixed between opposing sidewalls 16, 18 of base member 2. Threaded nut 104 has a rectangular profile and is dimensioned to be held against rotation of threaded nut 104 by the corresponding rectangular shape of the hollow interior of base member 2 but to permit slidable movement of threaded nut 104 lengthwise of base member 2. A knob 106 is fixed to the end of rod 98 extending exterior of end 102 of butt support member 10 to permit manual rotation of rod 98 to loosen or tighten nut 104 on threaded end 103 of rod 98. Loosening of nut 104 results in forward movement of threaded nut 104 lengthwise relative to base member 2 to decrease the resistance of compression spring 103 to rearward movement of rod 98 and butt support member 10, and tightening of nut 104 results in rearward movement of threaded nut 104 lengthwise relative to base member 2 to increase the resistance of compression spring 103 to rearward movement of rod 98 and butt support member 10. When a firearm having its butt received in one of receivers 82, 84 is fired, the force of recoil is transmitted through respective butt receiver 82 or 84, butt support member 10, and rod 98 to nut 104, and is absorbed by compression spring 103.

Figure 5:
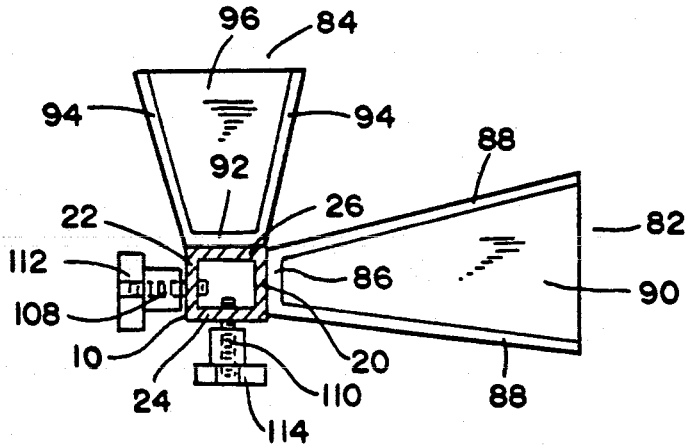
FIG. 5 is a transverse cross-sectional view of the device of FIG. 1 along the line V—V of FIG. 4.

To permit rotation of butt support member 10 and pivoting of butt receivers 82, 84 relative to the longitudinal axis of base member 2, rod 98 can be further rotated to further loosen nut 104 resulting in further forward movement of threaded nut 104 lengthwise of base member 2 and accompanying further decrease in the resistance of compression spring 103 to rearward movement of rod 98 and butt support member 10, permitting butt support member 10 to be manually pulled in a rearward direction whereby extension 28 of butt support member 10 can be disengaged from rearward end 6 of base member 2 to allow rotation of butt support member 10 and butt receivers 82, 84 relative to the longitudinal axis of base member 2. When extension 28 of butt support member 10 is thus disengaged from rearward end 6 of base member 2, butt receivers 82, 84, respectively, can be pivoted between upright positions above the longitudinal axis of base member 2 and lateral positions relative to the longitudinal axis of base member 2 upon rotation of the butt support member 10. Threaded adjusting screws 108, 110, respectively, FIG. 5, are fixed respectively, to bottom 22 and sidewall 24 of butt support member 10. To provide height adjustment for butt receivers 82 and 84, respectively, when receivers 82, 84 are pivoted, respectively, to an upright position above the longitudinal axis of the base member 2, knobs 112, 114, have correspondingly threaded holes formed axially therein and are rotatably mounted on adjusting screws 108, 110, respectively. Height adjustment of butt receivers 82, 84, respectively, is accomplished by manually rotating knobs 112, 114, respectively, on adjusting screws 108, 110, respectively.

What is claimed is:

1. A device for supporting and sighting a firearm having a barrel and a butt comprising:

an elongate base member having opposing forward and rearward ends;

a butt support member engaged at th. rearward end of the base member;

butt receiving means mounted on the butt support member;

barrel support means mounted on the base member forward of its rearward end;

barrel receiving means disposed above the base member;

an elongate link pivoted at one of its ends to the barrel support means and at its other end to the barrel receiving means, to permit pivotal movement of the barrel receiving means relative to the base member between positions forward of the barrel support means to accommodate an elongate firearm and rearward of the barrel support means to accommodate a relatively short firearm; and means carried by the link for adjusting the height of the barrel receiving means relative to the base member.

2. A device according to claim 1 wherein the barrel support means is moveable between selected positions lengthwise of the base member.

3. A device according to claim 2 wherein the barrel support means includes means for locking the barrel support means in position on the base member.

4. A device according to claim 3 wherein said butt support member is engaged for slidable movement lengthwise relative to the base member at the rearward end of the base member; and further comprising a spring fixed between the base member and the butt support member.

5. A device according to claim 4, said link having a threaded hole formed therein intermediate its opposing ends; and wherein said means for adjusting the height of the barrel receiving means comprises a correspondingly threaded adjusting screw rotatably mounted in said threaded hole and having one of the opposing ends of said adjusting screw resting on the base member.

6. A device according to claim 5 wherein said butt support member is rotatable relative to the longitudinal axis of the base member; and wherein said butt receiving means comprises first and second butt receivers, both pivotable about the longitudinal axis of the base member between upright positions above the longitudinal axis of the base member and lateral positions relative to the longitudinal axis of the base member upon rotation of the butt support member, said first and second butt receivers being positioned, respectively, on the butt support member so that when one of said first and second butt receivers is pivoted to an upright position above the longitudinal axis of the base member, the other of said first and second butt receivers is caused to be pivoted to a lateral position relative to the longitudinal axis of the base member.

7. A device according to claim 6 wherein said barrel support means comprises a generally U-shaped bracket having a pair of opposing upstanding legs connected by a bottom member, said bottom member extending under the base member, and said opposing legs, each having a hole formed therein, extending upwardly on opposing sides of the base member; and wherein said locking means comprises a carriage bolt having a head and opposing threaded end mounted through said holes, said threaded end being received by a correspondingly threaded nut disposed adjacent one of said holes, said link being pivoted at said one of its ends to said carriage bolt.

8. A device according to claim 7, wherein said spring comprises a compression spring; and further comprising a compression spring adjusting screw having one of its ends engaged by the butt support member and its opposing end threaded for rotatable engagement by a threaded nut carried by the base member for slidable movement of the threaded nut lengthwise of the base member; and a spring stop fixed to the base member intermediate the threaded nut and the rearward end of the base member, the compression spring being disposed between the threaded nut and the spring stop.

9. A device according to claim 8 further comprising first and second threaded adjusting screws disposed, respectively, on the butt support member in opposing relationship to the respective first and second butt receivers, each adjusting screw having a correspondingly threaded adjusting knob rotatably mounted thereon for adjusting the height of the first and second butt receivers, respectively, when said first and second butt receivers are positioned, respectively, above the longitudinal axis of the base member.

10. A device according to claim 9 wherein said barrel receiver comprises a pair of opposing spaced-apart, obliquely disposed upstanding sidewalls between which the barrel of a firearm is receivable;

wherein one of said butt receivers comprises a bottom connecting a pair of spaced-apart, obliquely disposed, upstanding sidewalls supporting a back wall therebetween and engageable by the butt of a shoulder-held firearm; and wherein the other of said butt receivers comprises a bottom connecting a pair of spaced-apart, obliquely disposed, upstanding sidewalls supporting a back wall therebetween and engageable by the butt of a hand-held firearm.

* * * * *